United States Patent [19]

Kleinschmidt et al.

[11] 4,223,208

[45] Sep. 16, 1980

[54] HEATER WITH A FERRO-ELECTRIC CERAMIC HEATING ELEMENT

[75] Inventors: Peter Kleinschmidt, Munich; Hans Meixner, Haar, both of Fed. Rep. of Germany

[73] Assignee: Siemens Aktiengesellschaft, Berlin & Munich, Fed. Rep. of Germany

[21] Appl. No.: 25,616

[22] Filed: Mar. 30, 1979

[30] Foreign Application Priority Data

Apr. 13, 1978 [DE] Fed. Rep. of Germany ..... 2816076

[51] Int. Cl.[3] ..... H05B 3/06

[52] U.S. Cl. ..... 219/530; 219/328; 218/439; 219/441; 219/504; 219/523; 219/540; 219/552; 338/22 R

[58] Field of Search ..... 219/328, 201, 504, 523, 219/505, 530, 437, 439, 441, 540, 541, 544, 552; 338/22 R, 225 D, 23, 217, 218; 99/520

[56] References Cited

U.S. PATENT DOCUMENTS

| | | | |
|---|---|---|---|
| 3,335,459 | 8/1967 | Tyrner | 219/523 X |
| 3,412,231 | 11/1968 | McElligott | 219/201 |
| 3,937,923 | 2/1976 | Smith | 219/523 |
| 3,940,591 | 2/1976 | Ting | 219/544 |
| 3,976,854 | 8/1976 | Ishikawa et al. | 219/505 |
| 3,996,447 | 12/1976 | Bouffard et al. | 219/540 X |
| 4,045,763 | 8/1977 | Miyamoto et al. | 338/23 |
| 4,147,927 | 4/1979 | Pivotte | 219/541 |
| 4,177,375 | 12/1979 | Meixner | 219/441 |

*Primary Examiner*—Volodymyr Y. Mayewsky
*Attorney, Agent, or Firm*—Hill, Van Santen, Steadman, Chiara & Simpson

[57] ABSTRACT

A heater is disclosed having a PTC thermistor heating element rigidly wedged in an intermediate space of the member to be heated by use of at least one wedge-shaped member. The wedge-shaped member has a surface which is at least the size of the heating elment so an optimum heat transmission is guaranteed.

17 Claims, 3 Drawing Figures

HEATER WITH A FERRO-ELECTRIC CERAMIC HEATING ELEMENT

BACKGROUND OF THE INVENTION

The invention relates to a heater with a ferro-electric ceramic heating element (PTC thermistor) having two heating surfaces which lie essentially opposite one another and which are both in heat-conducting connection with a member to be heated.

In the earlier U.S. Pat. No. 4,177,375 issues Dec. 4, 1979 of Hans Meixmer and the U.S. application Ser. No. 012,053 filed Feb. 13, 1979 of Hans Meixner, both of which are incorporated herein by reference, when using a disk-shaped ceramic heating element consisting, for example, of doped barium titanate, I have suggested to design the heat contact of this heating element relative to a member to be heated such that the heat produced by the two heating surfaces of the heating element is drawn off equally well from the two surfaces. An equal heat conduction on the two sides of the heating element is therefore preferred to an extremely good dissipation of heat conduction, for example, on one side only. This technique is used to guarantee the same thermal conditions and particularly the same temperature when the heating element is in operation, said element which advantageously is to be delimited to a thickness of only 0.5 to 2 mm across the thickness of the element. Therefore a self-stabilizing temperature of the heating element is guaranteed. The self-stabilization per se is based upon the PTC thermistor effect with a specific electric impedance rising suddenly with the Curie-temperature. The above reference provide details for design and construction of a PTC thermistor-ceramic heating element. However, difficulties can nevertheless sometimes occur in that a heat contact between the heating surfaces of the heating element, on the one hand, and the heat absorption surfaces of the member to be heated and positioned opposite thereof, on the other hand, exists. This heat contact is not yet even and sufficient.

SUMMARY OF THE INVENTION

It is an object of the present invention to suggest techniques with the aid of which an extremely good heat contact is guaranteed.

This object is inventively resolved with a heater having two heating surfaces lying substantially opposite one another and which are both in substantially equal heat-conducting connection with a member to be heated. The member has at least a pair of heat absorption surfaces opposite one another between which an intermediate space is defined in which the heating element is positioned. The heating surfaces of the heating element and the heat absorption surfaces lie respectively opposite one another. A wedge-shaped member comprising heat-conductive material is wedged into the intermediate space between at least one of the heat absorption surfaces and one of the heating surfaces for creating an intimate high pressure heating connection between a total surface of each of the heat absorption surfaces and the respective heating surfaces.

DESCRIPTION OF THE PREFERRED EMBODIMENTS

Figure 1:
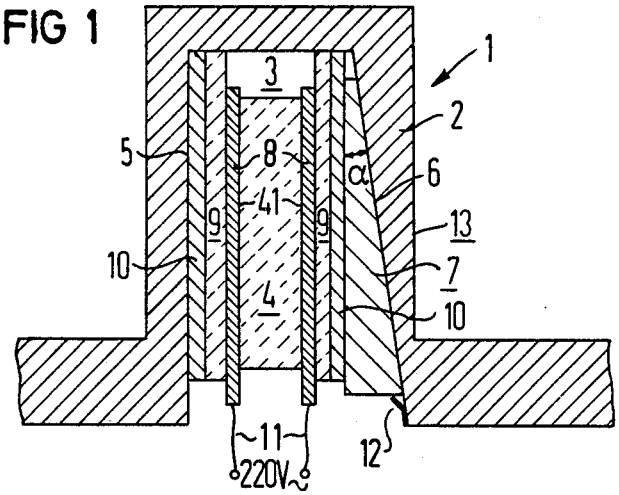
FIG. 1 illustrates in cross-sectional view a first embodiment of the invention.

One embodiment of an inventive heater, referenced 1, is illustrated in the sectional view in FIG. 1. The member 2 to be heated consists of a properly heat-conducting material, in particular aluminum. The intermediate space 3 is used for accommodating the ferro-electric ceramic heating element 4. Heat absorption surfaces 5 and 6 lie opposite one another and form a wedge angle in this sample embodiment. 41 illustrates the heating surfaces of heating element 4.

A wedge-shaped member of the invention is referenced 7.

8 illustrates the electrically conductive electrodes mounted on the surface of the circular disk-shaped heating element 4, for example; 9 references the electrically insulating shims or spacers; and 10 the additional spacers consisting of ductile material such as aluminum, lead, copper, heat-conductor paste, and the like.

The heating element 4 with its electrodes 8 and the spacers 9 and 10 in intermediate space 3 between the heat absorption surfaces 5 and 6 of member 2 to be heated can be so rigidly wedged in with the aid of wedge-shaped member 7 that the tightest contact possible exists between the surfaces respectively lying atop one another. Therefore, not only a heat removal from the heating element into member 2 to be heated, which is equally efficient on both sides, but also a quantitatively great heat removal can be obtained. The ductile spacers guarantee that large heat expansions are taken in stride without damage in spite of the great pressure from the individual materials, in particular the material of the heating element.

A wedge angle $\alpha$ is provided for the wedge-shaped member 7, said angle being selected in dependence upon the slide module between the wedge surfaces and the surfaces abutting the wedge-shaped member 7, i.e. of the heat absorption surface 6 and the one surface of the ductile foil 10, such that the wedge-shaped member can never slide out by itself with pressure forces occurring during operation. If necessary, a spreader guard 12 can be provided which guarantees an additional support of the wedge-shaped member 7, for example, against jarring forces. The wedge-shaped member 7 can consist of metal such as aluminum, for example, or also of a properly heat-conductive insulation material, for example, aluminum oxide.

The ductile foil 10 can accommodate thermally produced thickness alterations. Different thermal expansions cross-wise relative to the thickness direction, for example, expansion of heating element 4 vis-a-vis member 2 to be heated, can be adjusted by slide movements.

11 references feed lines for electrodes 8 which are used for connecting the operating voltage of the heating element, for example, 220 volts.

In the longitudinal direction, i.e. perpendicularly relative to the illustration plane of FIG. 1, member 2 to be heated can have a greater length so that, for example, in the intermediate space 3, in the plane of FIG. 1, several successive heating elements 4 with at least one respective additional wedge-shaped member 7 and the spacers are successively arranged. With the aid of wedge-shaped member 7, even thickness tolerances of the individual ceramic heating elements 4 which are sometimes unavoidable can be compensated for since member 7 is driven more or less deeply into the space remaining for the wedge in intermediate space 3.

Figure 2:
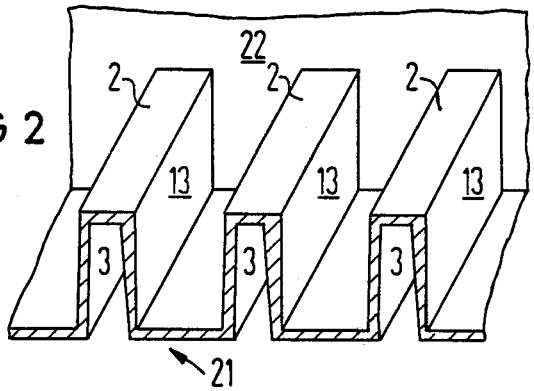
FIG. 2 shows an integrated heating member with an embodiment according to FIG. 1.

The outer surfaces of the member 2 to be heated and referenced 13 can be circulated around by a liquid to be heated for use, for example, in a coffee machine. An integrated heating member can, for example, consist of a member 21 schematically indicated in FIG. 2 (in sectional view and only partially illustrated), this member 21 having a number of intermediate spaces 3 in order to accommodate one or more heating elements 4, respectively. For the sake of overview, these heating elements 4 to be mounted into intermediate spaces 3 (FIG. 2) and the respective details, for example spacers 9, 10 and the wedge-shaped members 7, are not illustrated. 22 illustrates a part of a housing wall forming the container for the liquid to be heated.

Figure 3:
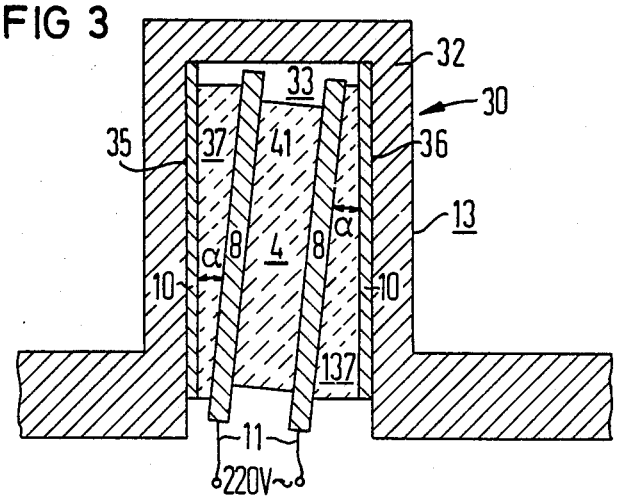
FIG. 3 shows another embodiment of the invention in cross-section.

FIG. 3 shows an embodiment 30 of the inventive heater, again in sectional illustration. The intermediate space 33, provided in member 32 to be heated, in this case has surfaces 35 and 36 in parallel and lying opposite one another which are heat-dissipating, said surfaces between which heating element 4, its electrodes 8, and its ductile spacers 10 and also two wedge-shaped members 37 and 137 preferably of an electrical insulating material are located. The wedge angles $\alpha$ of the two wedge-shaped members 37, 137 are arranged in opposition relative to one another so that over the total cross-section the same thickness of the individual components 4, 8, 10, 37, and 137 exists.

It is essential for the invention that the wedge-shaped members 7, 37 and 137 are sufficiently large so that they comprise at least the vertical (relative to illustration plane of FIGS. 1 and 3) cross-sectional surface of heating element 4. Therefore it is guaranteed that heat flow from heating element 4 into member 2 or 32 to be heated occurs without hindrance and accumulation.

The form illustrated in the Figures for the member 2 with its outer surfaces 12 to be heated achieves the goal to design a heater in rib-shape for a proper heat removal. Such a rib design is obvious from the schematic FIG. 2, in particular.

In such an inventive heater no difficulties occur resulting from less accuracy due to the size of the heater system. Due to the multiplicity of mating components, a disadvantageous sum formation of the tolerances could occur on the one or the other side. However, this can readily be compensated for with the aid of the invention. In particular, due to the uniformity of the contact pressure obtained on the basis of the wedge-shaped members over the total cross-sectional surface, not only a smaller danger of breaking exists but unusually high contact pressures can also be utilized without damage. The contact pressures can be so great that thickness alterations occurring due to heat expansion can never lead to an elimination of the contact pressure.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A heater comprising: a ferro-electric PTC thermistor ceramic plate-shaped heating element having two substantially flat heating surfaces lying substantially opposite one another and which are both in substantially equal heat-conducting connection with a member to be heated; means for feeding a current through the heating element which has at least one surface electrically insulated from the member to be heated; said member having spaced walls of heat conductive material joined by a third wall so as to provide at least a pair of flat heat absorption surfaces opposite one another between which an intermediate space is defined in which the heating element is positioned; the heating surfaces of the heating element and the heat absorption surfaces lying respectively opposite one another; and wedge-shaped means comprising heat-conductive material wedged into the intermediate space between at least one of the heat absorption surfaces and one of the heating surfaces for creating intimate high pressure heating connection between a total surface of each of the heat absorption surfaces and the respective heating surface.

2. A heater according to claim 1 wherein the wedge-shaped means has an angle $\alpha$ and that one of the heat absorption surfaces of the intermediate spaced is arranged with an incline with respect to the other heat absorption surface by the angle $\alpha$ of the wedge-shaped means.

3. A heater according to claim 1 wherein the heat absorption surfaces defining the intermediate space are arranged substantially parallel to one another and a wedge-shaped means is provided adjacent each heat absorption surface with its wedge angle oriented opposite to a wedge angle of the opposite wedge-shaped means.

4. A heater according to claim 1 wherein the wedge-shaped member means comprises an electrically insulating material.

5. A heater according to claim 1 wherein a spacer comprising a ductile material is provided between at least one of the heating surfaces and a respective one of the heat absorption surfaces.

6. A heater according to claim 5 wherein a foil comprising lead with a thickness of 0.2 to 1 mm thickness is provided as the spacer.

7. A heater according to claim 1 wherein a spacer of electrically insulating material is provided between at least one of the heating surfaces and the respective heat absorption surface.

8. A heater according to claim 7 wherein the spacer comprises a ductile material.

9. A heater according to claim 8 wherein the ductile material is a heat-conducting silicon rubber filled with metal oxide.

10. A heater according to claim 1 wherein an angle $\alpha$ of incline of the wedge-shaped means is dependent upon a slide modulus between the heat absorption surface in abutting contact with the surface of the wedge-shaped means, said angle $\alpha$ being selected such that the wedge-shaped means will not slide out with pressure forces occurring during normal operation.

11. A heater according to claim 1 wherein a barrier means is provided for safeguarding against jarring out of the wedge-shaped means.

12. A heater according to claim 1 wherein outer surfaces of the member to be heated are circulated around by liquid.

13. A heater according to claim 1 wherein an area of a surface of the wedge-shaped means is at least as large as a surface area of each of the heating element heating surfaces.

14. A heater system, comprising: a member to be heated having spaced walls of heat conductive material joined by a third wall so as to provide first and second absorption surfaces facing one another; a ferro-electric PTC thermistor plate-shaped heating element having two substantially flat opposite heating surfaces and positioned between the first and second surfaces; means for feeding a current through the heating element which has at least one surface electrically insulated from the member to be heated; a ductile spacer between each absorption surface and the heating element; and a wedge-shaped heat conducting member wedged between the first surface and the heating element, the member having an incline angle corresponding with an incline angle of the first surface relative to the second surface, an area of one of the surfaces of the wedge-shaped member being at least as large as one of the heating surfaces of the heating element.

15. A heater system, comprising: a member to be heated having spaced walls of heat conductive material joined by a third wall so as to provide first and second substantially parallel spaced apart absorption surfaces; a ferro-electric PTC thermistor plate-shaped heating element having two substantially flat opposite heating surfaces and positioned between the first and second surfaces; means for feeding a current through the heating element which has at least one surface electrically insulated from the member to be heated; a ductile spacer between each absorption surface and the heating element; and first and second wedge-shaped heat conducting members respectively wedged between the first and second absorption surfaces and the heating element in reverse position relative to one another, an incline angle of each member being the same, and an area of one of the surfaces of each of the wedge-shaped members being at least as large as the heating surfaces of the heating element.

16. A heater system, comprising: a member to be heated having a U-shaped region formed of spaced walls of heat conductive material joined by a third wall so as to provide first and second absorption surfaces facing one another; a ferro-electric PTC thermistor plate-shaped heating element having two substantially flat opposite heating surfaces which are parallel to one another and positioned between the first and second surfaces; means for feeding a current through the heating element; a ductile spacer and an insulating spacer between each absorption surface and the heating element; a wedge-shaped heat conducting member wedged between the first surface and the heating element, the member having an incline angle corresponding with an incline angle of the first surface relative to the second surface, an area of one of the surfaces of the wedge-shaped member being at least as large as one of the heating surfaces of the heating element; and the heating element having substantially equal heat conduction from both heating surfaces.

17. A heater system, comprising: a member to be heated having a U-shaped region formed of spaced walls of heat conductive material joined by a third wall so as to provide first and second substantially parallel spaced apart absorption surfaces; a ferro-electric PTC thermistor plateshaped heating element having two substantially flat opposite heating surfaces which are parallel to another, and positioned between the first and second surfaces; means for feeding a current through the heating element; a ductile spacer and an insulating spacer between each absorption surface and the heating element; first and second wedge-shaped heat conducting members respectively wedged between the first and second absorption surfaces and the heating element in reverse position relative to one another, an incline angle of each member being the same, and an area of one of the surfaces of each of the wedge-shaped members being at least as large as the heating surfaces of the heating element; and the heating element having substantially equal heat conduction from both heating surfaces.

* * * * *